US011225971B2

(12) United States Patent
Ueda et al.

(10) Patent No.: US 11,225,971 B2
(45) Date of Patent: Jan. 18, 2022

(54) ROTARY COMPRESSOR

(71) Applicant: FUJITSU GENERAL LIMITED, Kanagawa (JP)

(72) Inventors: Kenshi Ueda, Kanagawa (JP); Yasuyuki Izumi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 122 days.

(21) Appl. No.: 16/631,659

(22) PCT Filed: Apr. 17, 2018

(86) PCT No.: PCT/JP2018/015825
§ 371 (c)(1),
(2) Date: Jan. 16, 2020

(87) PCT Pub. No.: WO2019/021550
PCT Pub. Date: Jan. 31, 2019

(65) Prior Publication Data

US 2020/0173439 A1 Jun. 4, 2020

(30) Foreign Application Priority Data

Jul. 27, 2017 (JP) ..... JP2017-145846

(51) Int. Cl.
*F04C 23/00* (2006.01)
*F04C 15/06* (2006.01)
(Continued)

(52) U.S. Cl.
CPC ..... *F04C 23/008* (2013.01); *F04C 18/3564* (2013.01); *F04C 29/042* (2013.01);
(Continued)

(58) Field of Classification Search
CPC .... F04C 23/008; F04C 18/3564; F04C 15/06; F04C 23/001; F04C 29/0007; F04C 29/12; F04C 29/028; F04B 1/12
See application file for complete search history.

(56) References Cited

U.S. PATENT DOCUMENTS 9,322,405 B2 * 4/2016 Ignatiev ..... F01C 1/46
9,427,866 B2 8/2016 Hasegawa
(Continued)

FOREIGN PATENT DOCUMENTS

CN 106168214 A 11/2016
CN 206035809 U 3/2017
(Continued)

OTHER PUBLICATIONS

Jul. 10, 2018, Japanese Office Action issued for related JP Application No. 2017-145846.
(Continued)

*Primary Examiner* — Deming Wan
(74) *Attorney, Agent, or Firm* — Paratus Law Group, PLLC

(57) ABSTRACT

A compression part of a rotary compressor includes an intermediate partition plate that is arranged between an upper cylinder and a lower cylinder, an upper vane that sections an upper cylinder chamber formed within the upper cylinder into an upper suction chamber and an upper compression chamber, and a lower vane that sections a lower cylinder chamber formed within the lower cylinder into a lower suction chamber and a lower compression chamber. The intermediate partition plate is formed with an injection hole that injects a liquid refrigerant into the upper compression chamber and the lower compression chamber and an injection passage that supplies the liquid refrigerant to the injection hole. The injection passage is formed along a straight line that does not cross a rotary shaft insertion hole into which a rotary shaft is inserted.

7 Claims, 5 Drawing Sheets

(51) Int. Cl.

| | |
|---|---|
| ***F04C 29/00*** | (2006.01) |
| ***F04C 29/12*** | (2006.01) |
| ***F04C 29/02*** | (2006.01) |
| ***F04B 1/12*** | (2020.01) |
| ***F04C 18/356*** | (2006.01) |
| *F04C 29/04* | (2006.01) |

(52) U.S. Cl.

CPC ..... *F04C 29/12* (2013.01); *F04C 2210/26* (2013.01); *F04C 2240/30* (2013.01); *F04C 2240/40* (2013.01); *F04C 2240/60* (2013.01); *F25B 2700/21152* (2013.01)

(56) References Cited

U.S. PATENT DOCUMENTS

| | | | | |
|---|---|---|---|---|
| 9,519,178 | B2 | 12/2016 | Moriwaki | |
| 10,458,408 | B2 * | 10/2019 | Morozumi | F04C 29/128 |
| 2012/0308425 | A1 * | 12/2012 | Morishita | F04C 23/008 418/259 |

FOREIGN PATENT DOCUMENTS

| | | | |
|---|---|---|---|
| CN | 106837790 | A | 6/2017 |
| CN | 206268076 | U | 6/2017 |
| JP | S57-076296 | A | 5/1982 |
| JP | S61-040958 | Y2 | 11/1986 |
| JP | S62-183094 | U | 11/1987 |
| JP | S63-033093 | Y2 | 9/1988 |
| JP | 2003-343467 | A | 12/2003 |
| JP | 2004-324652 | A | 11/2004 |
| JP | 2015-135090 | A | 7/2015 |
| JP | 5776296 | B2 | 9/2015 |
| JP | 2016-017559 | A | 2/2016 |
| JP | 6140958 | B2 | 6/2017 |

OTHER PUBLICATIONS

Dec. 9, 2020, Australian Examination Report issued for related AU application No. 2018306966.

Mar. 30, 2021, Chinese Office Action issued for related CN application No. 201880047170.1.

* cited by examiner

ROTARY COMPRESSOR

CROSS REFERENCE TO PRIOR APPLICATION

This application is a National Stage Patent Application of PCT International Patent Application No. PCT/JP2018/015825 (filed on Apr. 17, 2018) under 35 U.S.C. § 371, which claims priority to Japanese Patent Application No. 2017-145846 (filed on Jul. 27, 2017), which are all hereby incorporated by reference in their entirety.

FIELD

The present invention relates to a rotary compressor.

BACKGROUND

A rotary compressor is known that injects a liquid refrigerant into a cylinder chamber in which a refrigerant is compressed to increase the compression efficiency of the refrigerant (refer to Patent Literature 1). A compression part of a two-cylinder rotary compressor includes an upper end plate blocking the upper side of an upper cylinder chamber, a lower end plate blocking the lower side of a lower cylinder chamber, and an intermediate partition plate separating the upper cylinder chamber and the lower cylinder chamber. The upper end plate is provided with an upper discharge hole causing an upper compression chamber of the upper cylinder chamber to communicate with an upper end plate cover chamber and is provided with a lead valve type upper discharge valve opening and closing the upper discharge hole. The lower end plate is provided with a lower discharge hole causing a lower compression chamber of the lower cylinder chamber to communicate with a lower end plate cover chamber and is provided with a lead valve type lower discharge valve opening and closing the lower discharge hole. The intermediate partition plate is provided with an injection hole and an injection passage supplying a liquid refrigerant to the injection hole. The rotary compressor injects the liquid refrigerant into the upper compression chamber and the lower compression chamber via the injection hole at a certain timing and can thereby improve efficiency.

CITATION LIST

Patent Literature

Patent Literature 1: Japanese Laid-open Patent Publication No. 2003-343467

SUMMARY

Technical Problem

The intermediate partition plate is formed such that the injection hole is arranged near the upper discharge hole and the lower discharge hole when the compression part is assembled, whereby the rotary compressor can appropriately inject the liquid refrigerant into the upper compression chamber and the lower compression chamber and improve efficiency. The intermediate partition plate is further formed with through holes such as bolt holes used for fixing a plurality of members included in the compression part together and refrigerant passages for passing the refrigerant therethrough, and these through holes are arranged near the upper discharge hole and the lower discharge hole when the compression part is assembled. In this case, there is a problem in that because the injection passage is required to be arranged avoiding these through holes, it is difficult for the injection hole to be arranged near the upper discharge hole and the lower discharge hole.

The disclosed technique has been made in view of the above, and an object thereof is to provide a rotary compressor in which the injection hole is arranged near the upper discharge hole and the lower discharge hole.

Solution to Problem

According to an aspect of an embodiment, a rotary compressor includes a compressor casing that is formed in a substantially cylindrical shape, is vertically installed, is provided with a discharge pipe discharging a refrigerant at an upper part, is provided with an upper suction pipe and a lower suction pipe sucking the refrigerant at a lower part of a side face, and is hermetically sealed, an accumulator that is fixed to a side part of the compressor casing and connected to the upper suction pipe and the lower suction pipe, a motor that is arranged within the compressor casing, and a compression part that is arranged below the motor within the compressor casing and driven by the motor to suck the refrigerant from the accumulator via the upper suction pipe and the lower suction pipe, compress the refrigerant, and discharge the refrigerant from the discharge pipe, wherein the compression part includes an upper cylinder that is formed in an annular shape, a lower cylinder that is formed in an annular shape, an upper end plate that blocks an upper side of the upper cylinder a lower end plate that blocks a lower side of the lower cylinder, an intermediate partition plate that is arranged between the upper cylinder and the lower cylinder to block a lower side of the upper cylinder and an upper side of the lower cylinder, a rotary shaft that is supported on a main shaft bearing provided in the upper end plate and a sub shaft bearing provided in the lower end plate and rotated by the motor, an upper eccentric part and a lower eccentric part that are provided on the rotary shaft with a phase difference of 180° with each other, an upper piston that is fitted over the upper eccentric part to form an upper cylinder chamber within the upper cylinder and is revolving along an inner circumferential face of the upper cylinder, a lower piston that is fitted over the lower eccentric part to form a lower cylinder chamber within the lower cylinder and is revolving along an inner circumferential face of the lower cylinder, an upper vane that protrudes from an upper vane groove formed in the upper cylinder into the upper cylinder chamber and is in contact with the upper piston to section the upper cylinder chamber into an upper suction chamber and an upper compression chamber, and a lower vane that protrudes from a lower vane groove formed in the lower cylinder into the lower cylinder chamber and is in contact with the lower piston to section the lower cylinder chamber into a lower suction chamber and a lower compression chamber, the intermediate partition plate being formed with an injection hole that injects a liquid refrigerant into the upper compression chamber and the lower compression chamber, and an injection passage that supplies the liquid refrigerant to the injection hole, the injection passage is formed along a straight line that does not cross a rotary shaft insertion hole into which the rotary shaft is inserted of the intermediate partition plate.

Advantageous Effects of Invention

An aspect of the rotary compressor disclosed by the present application enables the injection hole to be arranged near the upper discharge hole and the lower discharge hole.

DESCRIPTION OF EMBODIMENTS

The following describes examples of a rotary compressor disclosed by the present application in detail based on the accompanying drawings. The following examples do not limit the rotary compressor disclosed by the present application.

First Embodiment

[Configuration of Rotary Compressor]

Figure 1:
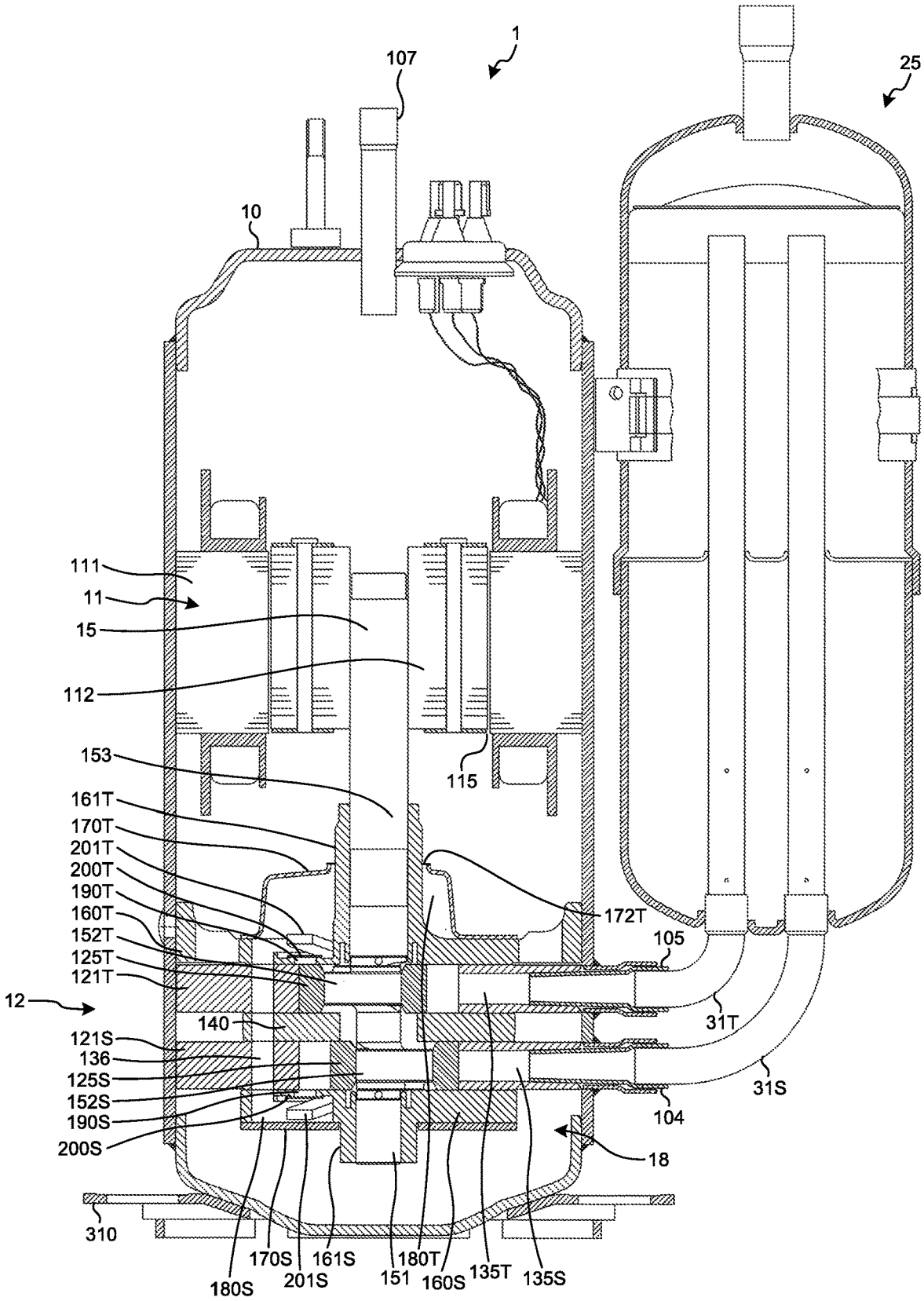
FIG. 1 is a vertical sectional view of a rotary compressor of a first embodiment.

FIG. 1 is a vertical sectional view of a rotary compressor 1 of a first embodiment. As illustrated in FIG. 1, the rotary compressor 1 includes a compressor casing 10, a compression part 12, a motor 11, and an accumulator 25. The compressor casing 10 is formed in a substantially cylindrical shape, seals a space formed therewithin, and is vertically installed. Under the compressor casing 10, mounting feet 310 locking a plurality of elastic support members (not illustrated) supporting the entire rotary compressor 1 are fixed. The accumulator 25 is formed in a cylindrical shape, is vertically installed, and is fixed to a side part of the compressor casing 10. The accumulator 25 includes an accumulator upper curved pipe 31T and an accumulator lower curved pipe 31S. The accumulator 25 separates a refrigerant supplied from an upstream instrument into a liquid refrigerant and a gas refrigerant and discharges the gas refrigerant via the accumulator upper curved pipe 31T and the accumulator lower curved pipe 31S.

The compressor casing 10 includes a lower suction pipe 104, an upper suction pipe 105, and a discharge pipe 107. The lower suction pipe 104 passes through a port formed at a lower part of a side face of the compressor casing 10; one end thereof is arranged within the compressor casing 10, whereas the other end thereof is arranged outside the compressor casing 10. The end of the lower suction pipe 104 arranged outside the compressor casing 10 is fit over the accumulator lower curved pipe 31S. The upper suction pipe 105 passes through a port formed above the lower suction pipe 104 at the lower part of the compressor casing 10; one end thereof is arranged within the compressor casing 10, whereas the other end thereof is arranged outside the compressor casing 10. The end of the upper suction pipe 105 arranged outside the compressor casing 10 is fit over the accumulator upper curved pipe 31T. The discharge pipe 107 passes through a port formed at an upper part of the compressor casing 10; one end thereof is arranged within the compressor casing 10, whereas the other end thereof is arranged outside the compressor casing 10.

The compression part 12 is arranged at a lower part within the compressor casing 10. The compression part 12 includes an upper end plate cover 170T, a lower end plate cover 170S, an upper end plate 160T, a lower end plate 160S, an upper cylinder 121T, a lower cylinder 121S, an intermediate partition plate 140, an upper piston 125T, a lower piston 125S, and a rotary shaft 15. The upper end plate cover 170T is formed with an upper end plate cover discharge hole 172T. The compression part 12 is further formed with a refrigerant passage 136. The refrigerant passage 136 is formed of a plurality of refrigerant passage holes each passing through the upper end plate 160T, the lower end plate 160S, the upper cylinder 121T, the lower cylinder 121S, and the intermediate partition plate 140.

A lubricant 18 is sealed within the compressor casing 10 in an amount with which the compression part 12 is almost immersed. The lubricant 18 is used for lubrication and sealing of sliding parts such as the upper piston 125T and the lower piston 125S sliding in the compression part 12.

The rotary shaft 15 is formed in a substantially cylindrical shape and includes a sub shaft 151 and a main shaft 153. The sub shaft 151 forms a lower part of the rotary shaft 15 and is rotatably supported on a sub shaft bearing 161S provided in the lower end plate 160S of the compression part 12. The main shaft 153 forms an upper part of the rotary shaft 15 and is rotatably supported on a main shaft bearing 161T provided in the upper end plate 160T of the compression part 12. The compression part 12 further includes an upper eccentric part 152T and a lower eccentric part 152S. The lower eccentric part 152S is arranged between the sub shaft 151 and the main shaft 153, that is, above the sub shaft 151. The upper eccentric part 152T is arranged between the lower eccentric part 152S and the main shaft 153, that is, below the main shaft 153 and is arranged above the lower eccentric part 152S. The upper eccentric part 152T and the lower eccentric part 152S are provided with a phase difference of 180° with each other and are fixed to the rotary shaft 15.

The motor 11 includes a stator 111 and a rotor 112. The stator 111 is formed in a substantially cylindrical shape, is arranged above the compression part 12 within the compressor casing 10, and is fixed to the inner circumferential face of the compressor casing 10 through shrink fitting or welding. The stator 111 includes a plurality of teeth around which a plurality of coils are each wound. Gaps are each formed between the teeth. The stator 111 is further provided with a notch on its outer circumference. The rotor 112 is arranged within the stator 111 and is fixed to the rotary shaft 15 through shrink fitting or welding. The motor 11 is formed with a gap 115 between the stator 111 and the rotor 112. A region on the lower side and a region on the upper side of the motor 11 within the compressor casing 10 communicate with each other via the gaps of the teeth, the notch on the outer circumferential face of the stator 111, and the gap 115. The motor 11 rotates the rotary shaft 15 using power supplied to the coils.

Figure 2:
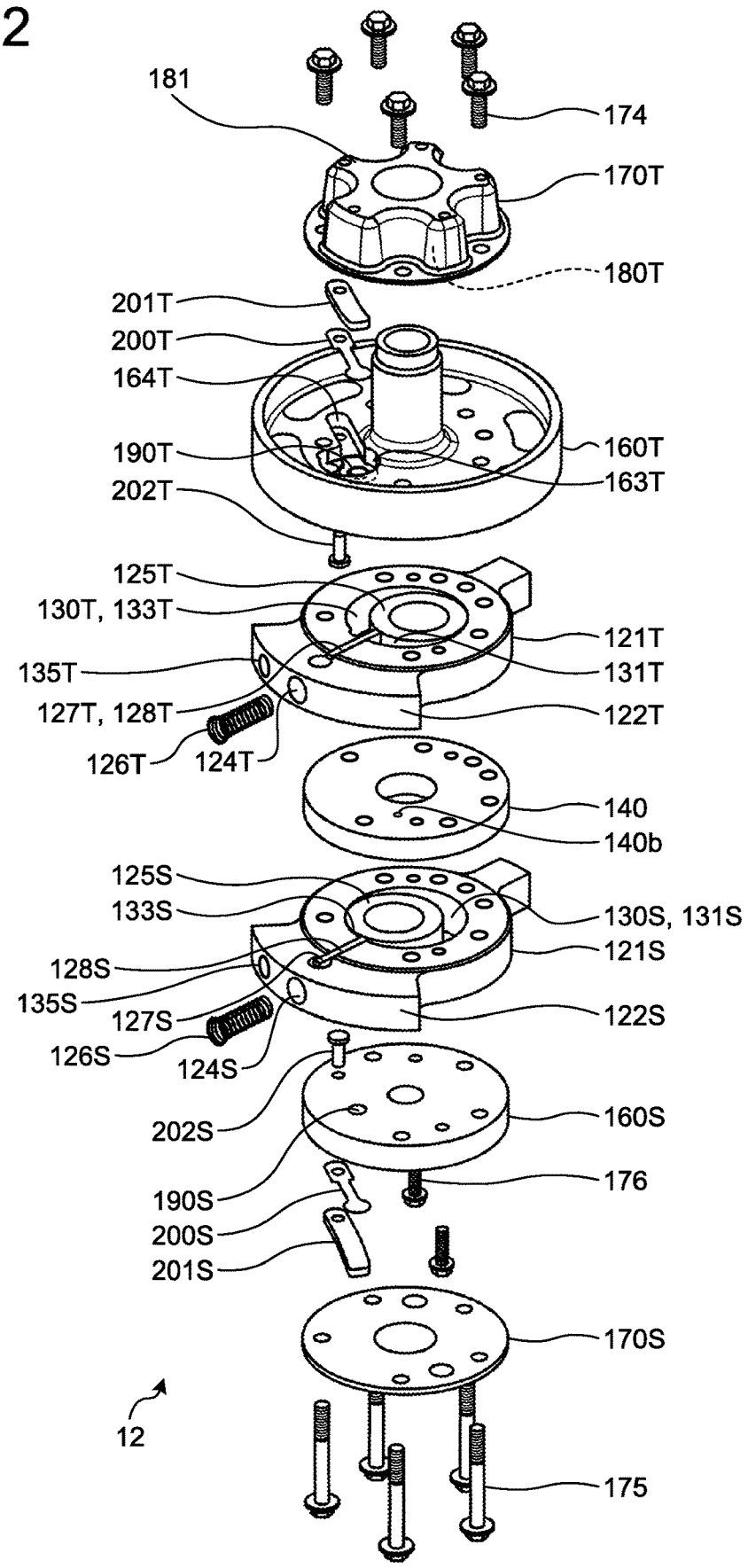
FIG. 2 is an exploded perspective view of a compression part of the rotary compressor of the first embodiment.

FIG. 2 is an exploded perspective view of the compression part 12 of the rotary compressor 1 of the first embodiment. As illustrated in FIG. 2, the compression part 12 includes the upper end plate cover 170T, the upper end plate 160T, the upper cylinder 121T, the intermediate partition plate 140, the lower cylinder 121S, the lower end plate 160S, and the lower end plate cover 170S stacked in this order from top. The upper cylinder 121T is formed in a substantially annular shape. The upper side of the inside of the upper cylinder 121T is blocked by the upper end plate 160T, whereas the lower side thereof is blocked by the intermediate partition plate 140. The lower cylinder 121S is formed in a substantially cylindrical shape. The upper side of the inside of the lower cylinder 121S is blocked by the intermediate partition plate 140, whereas the lower side thereof is blocked by the lower end plate 160S. The upper end plate cover 170T, the upper end plate 160T, the upper cylinder 121T, the intermediate partition plate 140, the lower cylinder 121S, the lower end plate 160S, and the lower end plate cover 170S are fixed together with a plurality of through bolts 174 and 175 and an auxiliary bolt 176.

The compression part 12 further includes an upper spring 126T, a lower spring 126S, an upper vane 127T, a lower vane 127S, an upper discharge valve 200T, a lower discharge valve 200S, an upper discharge valve retainer 201T, a lower discharge valve retainer 201S, an upper rivet 202T, and a lower rivet 202S. The upper spring 126T and the lower spring 126S are each formed of a compression coil spring. The upper vane 127T and the lower vane 127S are each formed in a plate shape. The upper rivet 202T fixes the upper discharge valve 200T and the upper discharge valve retainer 201T to the upper end plate 160T. The lower rivet 202S fixes the lower discharge valve 200S and the lower discharge valve retainer 201S to the lower end plate 160S.

Figure 3:
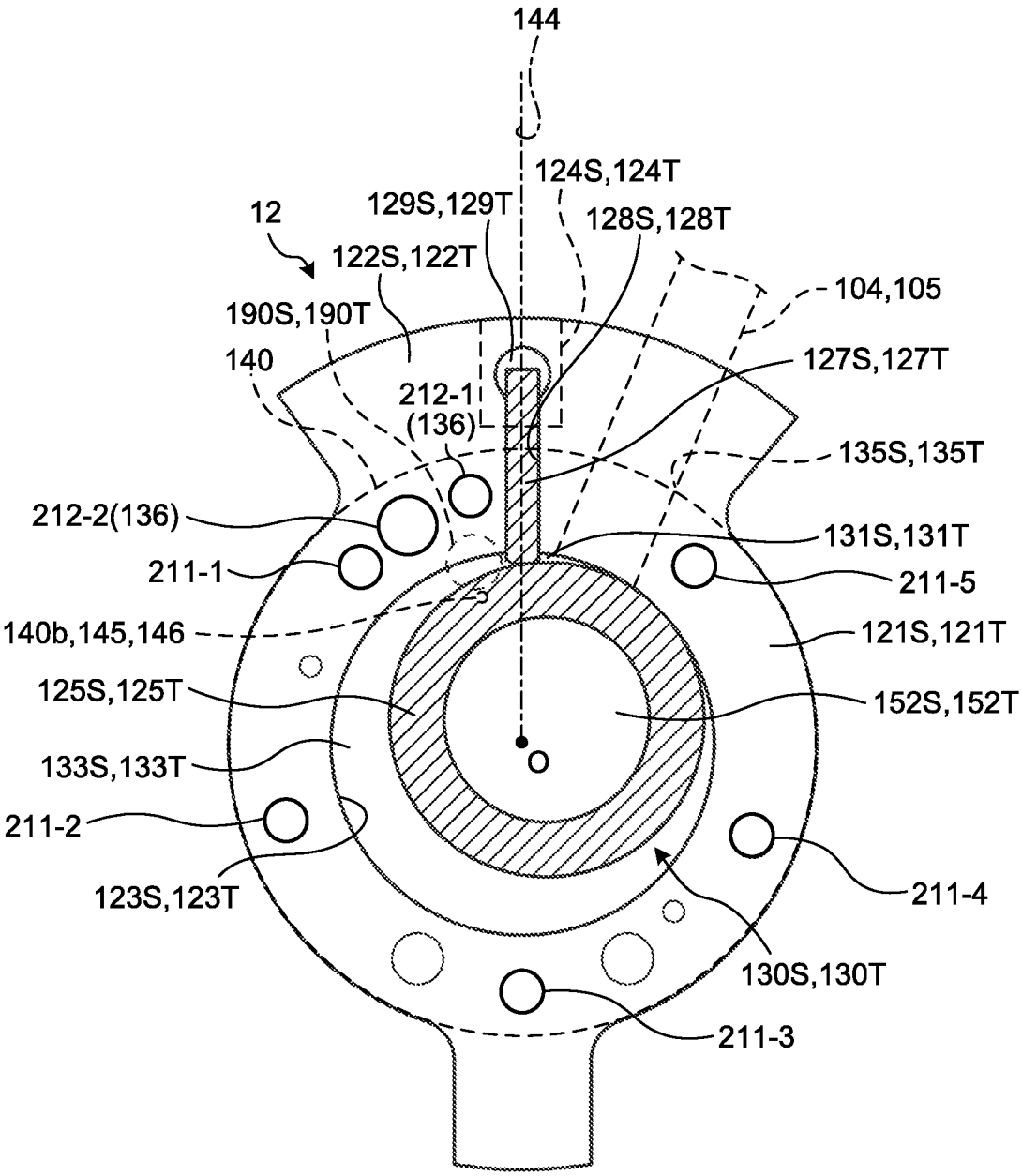
FIG. 3 is a lateral sectional view viewing the compression part of the rotary compressor of the first embodiment from below.

FIG. 3 is a lateral sectional view viewing the compression part 12 of the rotary compressor 1 of the first embodiment from below. As illustrated in FIG. 3, the lower piston 125S is formed in a cylindrical shape, in which the outer diameter thereof is formed to be smaller than the inner diameter of the lower cylinder 121S. The lower piston 125S is arranged within the cylinder of the lower cylinder 121S. The lower cylinder 121S is formed with a lower cylinder inner wall 123S. The lower cylinder inner wall 123S is formed so as to be along a circle with a rotational center line O of the rotary shaft 15 as the center, that is, so as to be along the side face of a cylinder with the rotational center line O as the central axis. The lower piston 125S is formed within the cylinder, whereby the lower cylinder 121S is formed with a lower cylinder chamber 130S between the lower cylinder inner wall 123S and the outer circumferential face of the lower piston 125S. That is to say, the lower cylinder chamber 130S is surrounded by the lower cylinder 121S, the lower piston 125S, the intermediate partition plate 140, and the lower end plate 160S. The lower eccentric part 152S is further fit within the cylinder of the lower piston 125S, which is supported on the lower eccentric part 152S rotatably relative to the lower eccentric part 152S. The lower piston 125S is fit over the lower eccentric part 152S to revolve about the rotational center line O in a revolution direction (the clockwise direction in FIG. 3) such that the outer circumferential face of the lower piston 125S slides over the lower cylinder inner wall 123S when the rotary shaft 15 rotates.

The lower cylinder 121S is formed with a lower lateral protruding part 122S. The lower lateral protruding part 122S is formed so as to project outward from a certain protruding range of the outer circumference of the lower cylinder 121S. The lower lateral protruding part 122S is used for fixing the lower cylinder 121S when the lower cylinder 121S is processed. The lower cylinder 121S is fixed by causing the lower lateral protruding part 122S to be held by a processing tool, for example. The lower lateral protruding part 122S is provided with a lower vane groove 128S extending radially outward from the lower cylinder chamber 130S. That is to say, the lower vane groove 128S is formed so as to be along a plane 144 overlapping with the rotational center line O. A lower vane 127S is arranged within the lower vane groove 128S in a slidable manner. That is to say, the lower vane 127S is arranged so as to be along the plane 144 to move along the plane 144.

The lower lateral protruding part 122S is provided with a lower spring hole 124S from the outside with a depth that does not reach the lower cylinder chamber 130S at a position overlapping with the lower vane groove 128S. In the lower spring hole 124S, the lower spring 126S (refer to FIG. 2) is arranged. One end of the lower spring 126S is in contact with the lower vane 127S, whereas the other end thereof is fixed to the lower cylinder 121S. The lower spring 126S gives the lower vane 127S an elastic force such that the lower vane 127S comes into contact with the outer circumferential face of the lower piston 125S.

The lower lateral protruding part 122S is formed with a lower pressure introduction path 129S. The lower pressure introduction path 129S causes the radial outside of the lower vane groove 128S and the inside of the compressor casing 10 to communicate with each other. The lower pressure introduction path 129S introduces a compressed refrigerant from the inside of the compressor casing 10 to the lower vane groove 128S and applies a back pressure to the lower vane 127S by the pressure of the refrigerant such that the lower vane 127S comes into contact with the outer circumferential face of the lower piston 125S.

The lower vane 127S comes into contact with the outer circumferential face of the lower piston 125S, whereby the lower cylinder chamber 130S is sectioned into a lower suction chamber 131S and a lower compression chamber 133S. The lower suction chamber 131S is formed on the revolution direction side of the lower piston 125S relative to the lower vane 127S. The lower compression chamber 133S is formed on the side opposite to the revolution direction of the lower piston 125S relative to the lower vane 127S. The lower lateral protruding part 122S of the lower cylinder 121S is further provided with a lower suction hole 135S. The lower suction hole 135S is formed so as to communicate with the lower suction chamber 131S and so as to be fit over the end of the lower suction pipe 104 arranged within the compressor casing 10.

The lower cylinder 121S is formed with a plurality of bolt holes 211-1 to 211-5 and a plurality of refrigerant passage holes 212-1 to 212-2. The bolt holes 211-1 to 211-5 are arranged at substantially regular intervals on a circle with the rotational center line O as the center. A first bolt hole 211-1 among the bolt holes 211-1 to 211-5 is arranged on the side opposite to the revolution direction of the lower piston 125S relative to the lower vane groove 128S. A second bolt hole 211-2 among the bolt holes 211-1 to 211-5 is arranged on the side opposite to the revolution direction of the lower piston 125S relative to the first bolt hole 211-1. A third bolt hole 211-3 among the bolt holes 211-1 to 211-5 is arranged on the side opposite to the revolution direction of the lower piston 125S relative to the second bolt hole 211-2. A fourth bolt hole 211-4 among the bolt holes 211-1 to 211-5 is arranged on the side opposite to the revolution direction of the lower piston 125S relative to the third bolt hole 211-3. A fifth bolt hole 211-5 among the bolt holes 211-1 to 211-5 is arranged on the side opposite to the revolution direction of the lower piston 125S relative to the fourth bolt hole 211-4, is arranged on the revolution direction side of the lower piston 125S relative to the first bolt hole 211-1, and is arranged on the revolution direction side of the lower piston 125S relative to the lower vane groove 128S. That is to say, the lower vane groove 128S is formed between the first bolt hole 211-1 and the fifth bolt hole 211-5. The through bolts 174 and 175 (refer to FIG. 2) are each inserted into the bolt holes 211-1 to 211-5.

A first refrigerant passage hole 212-1 among the refrigerant passage holes 212-1 to 212-2 is arranged between the lower vane groove 128S and the first bolt hole 211-1. A second refrigerant passage hole 212-2 among the refrigerant passage holes 212-1 to 212-2 is arranged between the first refrigerant passage hole 212-1 and the first bolt hole 211-1, that is, on the side opposite to the revolution direction of the lower piston 125S relative to the first refrigerant passage hole 212-1. The refrigerant passage holes 212-1 to 212-2 form part of the refrigerant passage 136 (refer to FIG. 1).

The upper cylinder 121T is formed in a manner similar to the lower cylinder 121S. That is to say, the upper piston 125T is formed in a cylindrical shape, in which the outer diameter thereof is formed to be smaller than the inner diameter of the upper cylinder 121T. The upper piston 125T is arranged within the cylinder of the upper cylinder 121T. The upper cylinder 121T is formed with an upper cylinder inner wall 123T. The upper cylinder inner wall 123T is formed so as to be along a circle with the rotational center line O as the center, that is, so as to be along the side face of a cylinder with the rotational center line O as the central axis. The upper piston 125T is formed within the cylinder, whereby the upper cylinder 121T is formed with an upper cylinder chamber 130T between the upper cylinder inner wall 123T and the outer circumferential face of the upper piston 125T. That is to say, the upper cylinder chamber 130T is surrounded by the upper cylinder 121T, the upper piston 125T, the intermediate partition plate 140, and the upper end plate 160T. The upper eccentric part 152T is further fit within the cylinder of the upper piston 125T, which is supported on the upper eccentric part 152T rotatably relative to the upper eccentric part 152T. The upper piston 125T is fit over the upper eccentric part 152T to revolve about the rotational center line O in a revolution direction (the clockwise direction in FIG. 3) such that the outer circumferential face of the upper piston 125T slides over the upper cylinder inner wall 123T when the rotary shaft 15 rotates.

The upper cylinder 121T is formed with an upper lateral protruding part 122T. The upper lateral protruding part 122T is formed so as to project outward from a certain protruding range of the outer circumference of the upper cylinder 121T. The upper lateral protruding part 122T is used for fixing the upper cylinder 121T when the upper cylinder 121T is processed. The upper cylinder 121T is fixed by causing the upper lateral protruding part 122T to be held by a processing tool, for example. The upper lateral protruding part 122T is provided with an upper vane groove 128T extending radially outward from the upper cylinder chamber 130T. That is to say, the upper vane groove 128T is formed so as to be along the plane 144 overlapping with the rotational center line O. An upper vane 127T is arranged within the upper vane groove 128T in a slidable manner. That is to say, the upper vane 127T is arranged so as to be along the plane 144 to move along the plane 144.

The upper lateral protruding part 122T is provided with an upper spring hole 124T from the outside with a depth that does not reach the upper cylinder chamber 130T at a position overlapping with the upper vane groove 128T. In the upper spring hole 124T, the upper spring 126T (refer to FIG. 2) is arranged. One end of the upper spring 126T is in contact with the upper vane 127T, whereas the other end thereof is fixed to the upper cylinder 121T. The upper spring 126T gives the upper vane 127T an elastic force such that the upper vane 127T comes into contact with the outer circumferential face of the upper piston 125T.

The upper lateral protruding part 122T is formed with an upper pressure introduction path 129T. The upper pressure introduction path 129T causes the radial outside of the upper vane groove 128T and the inside of the compressor casing 10 to communicate with each other. The upper pressure introduction path 129T introduces a compressed refrigerant from the inside of the compressor casing 10 to the upper vane groove 128T and the pressure of the refrigerant applies a back pressure to the upper vane 127T such that the upper vane 127T comes into contact with the outer circumferential face of the upper piston 125T.

The upper vane 127T comes into contact with the outer circumferential face of the upper piston 125T, whereby the upper cylinder chamber 130T is sectioned into an upper suction chamber 131T and an upper compression chamber 133T. The upper suction chamber 131T is formed on the revolution direction side of the upper piston 125T relative to the upper vane 127T. The upper compression chamber 133T is formed on the side opposite to the revolution direction of the upper piston 125T relative to the upper vane 127T. The upper lateral protruding part 122T of the upper cylinder 121T is further provided with an upper suction hole 135T. The upper suction hole 135T is formed so as to communicate with the upper suction chamber 131T and so as to be fit over the end of the upper suction pipe 105 arranged within the compressor casing 10.

The upper cylinder 121T is formed with the bolt holes 211-1 to 211-5 and the refrigerant passage holes 212-1 to 212-2. The bolt holes 211-1 to 211-5 are arranged at substantially regular intervals on the circle with the rotational center line O as the center. The first bolt hole 211-1 among the bolt holes 211-1 to 211-5 is arranged on the side opposite to the revolution direction of the upper piston 125T relative to the upper vane groove 128T. The second bolt hole 211-2 among the bolt holes 211-1 to 211-5 is arranged on the side opposite to the revolution direction of the upper piston 125T relative to the first bolt hole 211-1. The third bolt hole 211-3 among the bolt holes 211-1 to 211-5 is arranged on the side opposite to the revolution direction of the upper piston 125T relative to the second bolt hole 211-2. The fourth bolt hole 211-4 among the bolt holes 211-1 to 211-5 is arranged on the side opposite to the revolution direction of the upper piston 125T relative to the third bolt hole 211-3. The fifth bolt hole 211-5 among the bolt holes 211-1 to 211-5 is arranged on the side opposite to the revolution direction of the upper piston 125T relative to the fourth bolt hole 211-4, is arranged on the revolution direction side of the upper piston 125T relative to the first bolt hole 211-1, and is arranged on the revolution direction side of the upper piston 125T relative to the upper vane groove 128T. That is to say, the upper vane groove 128T is formed between the first bolt hole 211-1 and the fifth bolt hole 211-5. The through bolts 174 and 175 (refer to FIG. 2) are each inserted into the bolt holes 211-1 to 211-5.

The first refrigerant passage hole 212-1 among the refrigerant passage holes 212-1 to 212-2 is arranged between the upper vane groove 128T and the first bolt hole 211-1. The second refrigerant passage hole 212-2 among the refrigerant passage holes 212-1 to 212-2 is arranged between the first refrigerant passage hole 212-1 and the first bolt hole 211-1 and, that is, is arranged on the side opposite to the revolution direction of the upper piston 125T relative to the first refrigerant passage hole 212-1. The refrigerant passage holes 212-1 to 212-2 form part of the refrigerant passage 136 (refer to FIG. 1).

Figure 4:
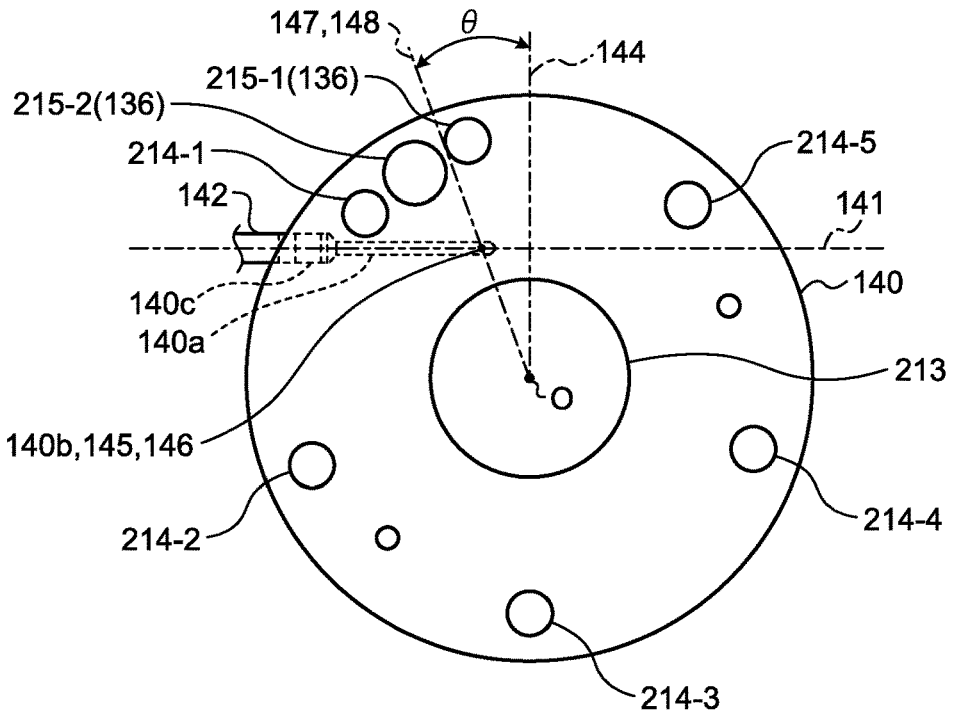
FIG. 4 is a bottom view of an intermediate partition plate of the rotary compressor of the first embodiment.

FIG. 4 is a bottom view of the intermediate partition plate 140 of the rotary compressor 1 of the first embodiment. The intermediate partition plate 140 is formed in a disc shape and is formed with a rotary shaft insertion hole 213, a plurality of bolt holes 214-1 to 214-5, a plurality of refrigerant passage holes 215-1 to 215-2, and an injection hole 140*b* as illustrated in FIG. 4. The rotary shaft insertion hole 213 is formed at the center of the intermediate partition plate 140 so as to pass through the intermediate partition plate 140. The rotary shaft 15 (refer to FIG. 1) is inserted into the rotary shaft insertion hole 213.

The bolt holes 214-1 to 214-5 are arranged at substantially regular intervals on a circle with the rotational center line O as the center. The bolt holes 214-1 to 214-5 are further formed so as to communicate with the bolt holes 211-1 to 211-5, respectively, of the upper cylinder 121T when the compression part 12 is assembled (refer to FIG. 3). The bolt holes 214-1 to 214-5 are further formed so as to communicate with the bolt holes 211-1 to 211-5, respectively, of the lower cylinder 121S when the compression part 12 is assembled (refer to FIG. 3). The through bolts 174 and 175 (refer to FIG. 2) are each inserted into the bolt holes 214-1 to 214-5.

The refrigerant passage holes 215-1 to 215-2 are formed so as to communicate with the refrigerant passage holes 212-1 to 212-2, respectively, of the upper cylinder 121T and so as to communicate with the refrigerant passage holes 212-1 to 212-2, respectively, of the lower cylinder 121S (refer to FIG. 3). The refrigerant passage holes 215-1 to 215-2 form part of the refrigerant passage 136 (refer to FIG. 1).

The injection hole 140*b* is formed so as to pass through the intermediate partition plate 140 along a straight line parallel to the rotational center line O. That is to say, the intermediate partition plate 140 is formed with an upper injection port 145 on its upper face facing the upper cylinder 121T and is formed with a lower injection port 146 on its lower face facing the lower cylinder 121S. The upper injection port 145 is formed from an end of the injection hole 140*b* facing the upper cylinder 121T. The lower injection port 146 is formed from an end of the injection hole 140*b* facing the lower cylinder 121S (refer to FIG. 3). The injection hole 140*b* is further arranged such that the upper piston 125T revolves, whereby the upper piston 125T opens and closes the upper injection port 145 (refer to FIG. 3). The injection hole 140*b* is connected to the upper compression chamber 133T via the upper injection port 145 when the upper piston 125T opens the upper injection port 145. The injection hole 140*b* is further arranged such that the lower piston 125S revolves, whereby the lower piston 125S opens and closes the lower injection port 146 (refer to FIG. 3). The injection hole 140*b* is connected to the lower compression chamber 133S via the lower injection port 146 when the lower piston 125S opens the lower injection port 146.

The injection hole 140*b* is further arranged such that a central angle θ formed by a perpendicular line 147 drawn from the upper injection port 145 to the rotational center line O and a straight line perpendicular to the rotational center line O among straight lines parallel to the plane 144 is 40° or less. The injection hole 140*b* is formed to be parallel to the rotational center line O and is thereby arranged in a similar manner also about the lower injection port 146. That is to say, similarly, the injection hole 140*b* is arranged such that the central angle θ formed by a perpendicular line 148 drawn from the lower injection port 146 to the rotational center line O and a straight line perpendicular to the rotational center line O among the straight lines parallel to the plane 144 is 40° or less.

Specifically, as illustrated in FIG. 4, when viewed in the direction of the rotary shaft 15, the center of the injection hole 140*b* is arranged within a range of a fan with a central angle θ about the rotational center line O of 40° or less from the center line of the upper vane groove 128T and the lower vane groove 128S (the upper vane 127T and the lower vane 127S) toward the side opposite to the connection positions between the compressor casing 10 and the upper suction pipe 105 and the lower suction pipe 104 in the circumferential direction of the rotary shaft 15.

In other words, in the circumferential direction of the rotary shaft 15, the center of the injection hole 140*b* is arranged within a range of a fan with a central angle θ about the rotational center line O of 40° or less from the center line of the upper vane groove 128T and the lower vane groove 128S toward the direction opposite to the revolution direction of the upper piston 125T and the lower piston 125S within the upper cylinder chamber 130T and the lower cylinder chamber 130S, that is, the direction opposite to the rotational direction of the rotary shaft 15.

The injection hole 140*b* is arranged between the rotary shaft insertion hole 213 and the first bolt hole 214-1 among the bolt holes 214-1 to 214-5. That is to say, the injection hole 140*b* is arranged in an area surrounded by two common outer tangential lines of the rotary shaft insertion hole 213 and the first bolt hole 214-1, the rotary shaft insertion hole 213, and the first bolt hole 214-1. The injection hole 140*b* is further arranged between the rotary shaft insertion hole 213 and the first refrigerant passage hole 215-1 among the refrigerant passage holes 215-1 to 215-2. That is to say, the injection hole 140*b* is arranged in an area surrounded by two common outer tangential lines of the rotary shaft insertion hole 213 and the first refrigerant passage hole 215-1, the rotary shaft insertion hole 213, and the first refrigerant passage hole 215-1. The injection hole 140*b* is further arranged between the rotary shaft insertion hole 213 and the second refrigerant passage hole 215-2 among the refrigerant passage holes 215-1 to 215-2. That is to say, the injection hole 140*b* is arranged in an area surrounded by two common outer tangential lines of the rotary shaft insertion hole 213 and the second refrigerant passage hole 215-2, the rotary shaft insertion hole 213, and the second refrigerant passage hole 215-2.

The intermediate partition plate 140 is further formed with an injection passage 140*a* and an injection pipe fitting part 140*c*. The injection passage 140*a* is formed linearly along a straight line 141. The straight line 141 is perpendicular to the rotational center line O and does not cross the rotary shaft insertion hole 213. That is to say, the straight line 141 does not cross the rotational center line O and does not cross the rotary shaft 15. Consequently, the injection passage 140*a* is not formed along the perpendicular line 147 and is not formed along the perpendicular line 148. The injection passage 140*a* crosses the injection hole 140*b* to communicate with the injection hole 140*b*. The injection passage 140*a* is a blind hole; one end thereof is arranged on the outer circumference of the intermediate partition plate 140, whereas the other end thereof is arranged within the intermediate partition plate 140 to be blocked. The injection pipe fitting part 140*c* is formed at the end of the injection passage 140*a* connected to the outside of the intermediate partition plate 140. The injection pipe fitting part 140*c* is formed to have an inner diameter larger than the inner diameter of the injection passage 140*a*.

The rotary compressor 1 further includes an injection pipe 142. The injection pipe 142 passes through an injection port formed in the compressor casing 10; one end thereof is arranged within the compressor casing 10, whereas the other end thereof is arranged outside the compressor casing 10. The one end of the injection pipe 142 arranged within the compressor casing 10 is fit into the injection pipe fitting part 140*c*. The other end of the injection pipe 142 arranged outside the compressor casing 10 is connected to an injection coupling pipe (not illustrated). The injection coupling pipe is connected to a refrigerant circulation path of a refrigerating cycle for which the rotary compressor 1 is used to supply a liquid refrigerant to the injection pipe 142.

Figure 5:
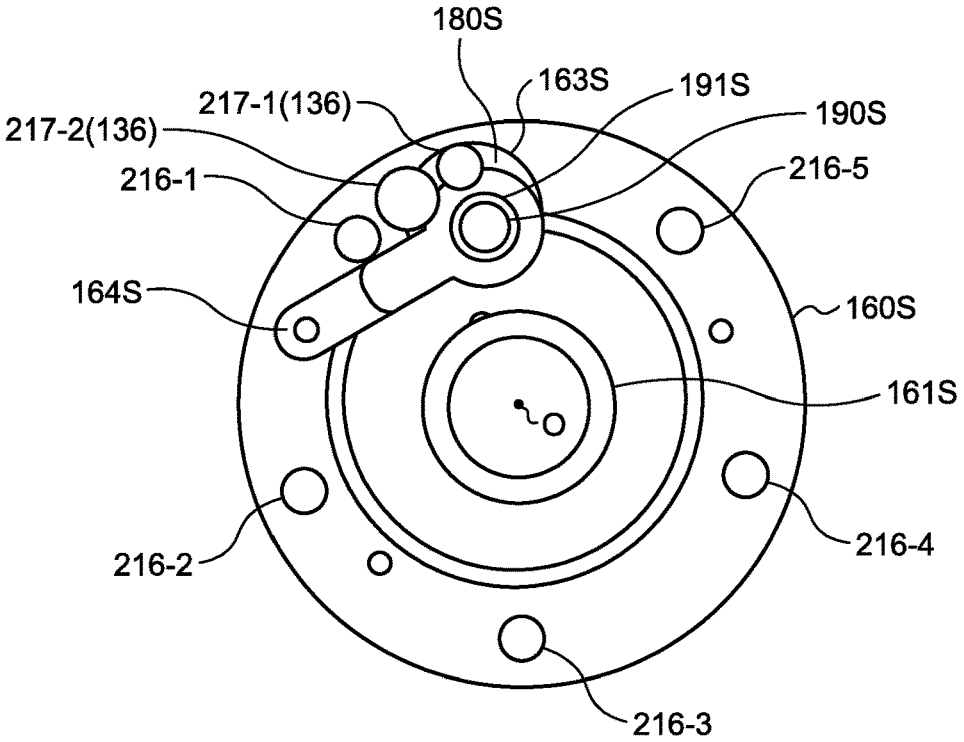
FIG. 5 is a bottom view of a lower end plate of the rotary compressor of the first embodiment.

FIG. 5 is a bottom view of the lower end plate 160S of the rotary compressor 1 of the first embodiment. As illustrated in FIG. 5, the lower end plate 160S is formed with a lower discharge hole 190S, a lower valve seat 191S, a lower discharge valve housing recess 164S, and a lower discharge chamber recess 163S. The lower discharge hole 190S is formed so as to pass through the lower end plate 160S and is arranged near the lower vane groove 128S so as to communicate with the lower compression chamber 133S of the lower cylinder 121S when the compression part 12 is assembled (refer to FIG. 3). The lower discharge chamber recess 163S is formed on the back of a face of the lower end plate 160S facing the lower cylinder 121S and is formed such that the lower discharge hole 190S is connected to the inside of the lower discharge chamber recess 163S. The lower valve seat 191S is formed so as to surround an opening of the lower discharge hole 190S of the bottom of the lower discharge chamber recess 163S and is formed such that the periphery of the opening of the lower discharge hole 190S rises in an annular shape from the bottom of the lower discharge chamber recess 163S.

The lower discharge valve housing recess 164S is formed on the back of the face of the lower end plate 160S facing the lower cylinder 121S and is formed in a groove shape extending in the circumferential direction of the lower end plate 160S from the lower discharge hole 190S. The lower discharge valve housing recess 164S has an end facing the lower discharge hole 190S overlapping with the lower discharge chamber recess 163S and is formed to be the same depth as the depth of the lower discharge chamber recess 163S such that the internal space of the lower discharge valve housing recess 164S communicates with the internal space of the lower discharge chamber recess 163S. The lower discharge valve housing recess 164S is formed such that its groove width is slightly larger than the width of the lower discharge valve 200S and the width of the lower discharge valve retainer 201S. The lower discharge valve housing recess 164S houses the lower discharge valve 200S and the lower discharge valve retainer 201S within its groove and positions the lower discharge valve 200S and the lower discharge valve retainer 201S.

The lower discharge valve 200S is formed in a lead valve shape; its rear end is fixed to the lower end plate 160S with the lower rivet 202S so as to cause its front part to be in contact with the lower valve seat 191S and to block the lower discharge hole 190S. The lower discharge valve 200S becomes elastically deformed to open the lower discharge hole 190S. The lower discharge valve retainer 201S is formed to have a curved (warped) front part, with its rear end overlapped with the lower discharge valve 200S and fixed to the lower end plate 160S with the lower rivet 202S. The lower discharge valve retainer 201S limits the degree of the elastic deformation of the lower discharge valve 200S to limit the degree of opening of the lower discharge hole 190S that the lower discharge valve 200S opens and closes.

The lower end plate 160S is further formed with a plurality of bolt holes 216-1 to 216-5 and a plurality of refrigerant passage holes 217-1 to 217-2. The bolt holes 216-1 to 216-5 are arranged at substantially regular intervals on a circle with the rotational center line O as the center. The bolt holes 216-1 to 216-5 are formed so as to communicate with the bolt holes 211-1 to 211-5, respectively, of the lower cylinder 121S when the compression part 12 is assembled (refer to FIG. 3). The through bolts 174 and 175 (refer to FIG. 2) are each inserted into the bolt holes 216-1 to 216-5.

The refrigerant passage holes 217-1 to 217-2 are formed so as to communicate with the refrigerant passage holes 212-1 to 212-2, respectively, of the lower cylinder 121S when the compression part 12 is assembled (refer to FIG. 3). The refrigerant passage holes 217-1 to 217-2 form part of the refrigerant passage 136 (refer to FIG. 1). The refrigerant passage holes 217-1 to 217-2 are further formed such that at least part thereof is arranged so as to overlap with the lower discharge chamber recess 163S to communicate with the internal space of the lower discharge chamber recess 163S.

The lower end plate cover 170S is fixed to the lower end plate 160S such that the lower end plate cover 170S is in intimate contact with the back of the face of the lower end plate 160S facing the lower cylinder 121S. The lower end plate cover 170S is formed to be plane (refer to FIG. 2). A lower end plate cover chamber 180S (refer to FIG. 1) is formed between the lower end plate 160S and the lower end plate cover 170S. The lower end plate cover 170S is formed to be plane, whereby the lower end plate cover chamber 180S is formed by the internal space of the lower discharge chamber recess 163S and the internal space of the lower discharge valve housing recess 164S provided in the lower end plate 160S.

The upper end plate 160T is formed in a manner substantially similar to the lower end plate 160S. That is to say, as illustrated in FIG. 2, the upper end plate 160T is formed with an upper discharge hole 190T, an upper discharge valve housing recess 164T, and an upper discharge chamber recess 163T. The upper discharge hole 190T is formed so as to pass through the upper end plate 160T and is arranged near the upper vane groove 128T so as to communicate with the upper compression chamber 133T of the upper cylinder 121T when the compression part 12 is assembled (refer to FIG. 3). The upper discharge chamber recess 163T is formed on the back of a face of the upper end plate 160T facing the upper cylinder 121T and is formed such that the upper discharge hole 190T is connected to the inside of the upper discharge chamber recess 163T.

The upper discharge valve housing recess 164T is formed on the back of the face of the upper end plate 160T facing the upper cylinder 121T and is formed in a groove shape extending in the circumferential direction of the upper end plate 160T from the upper discharge hole 190T. The upper discharge valve housing recess 164T has an end facing the upper discharge hole 190T overlapping with the upper discharge chamber recess 163T and is formed to be the same depth as the depth of the upper discharge chamber recess 163T such that the internal space of the upper discharge valve housing recess 164T communicates with the internal space of the upper discharge chamber recess 163T. The upper discharge valve housing recess 164T is formed such that its groove width is slightly larger than the width of the upper discharge valve 200T and the width of the upper discharge valve retainer 201T. The upper discharge valve housing recess 164T houses the upper discharge valve 200T and the upper discharge valve retainer 201T within its groove and positions the upper discharge valve 200T and the upper discharge valve retainer 201T.

The upper discharge valve 200T is formed in a lead valve shape; its rear end is fixed to the upper end plate 160T with the upper rivet 202T so as to cause its front part to block the upper discharge hole 190T. The upper discharge valve 200T becomes elastically deformed to open the upper discharge hole 190T. The upper discharge valve retainer 201T is formed to have a curved (warped) front part, with its rear end overlapped with the upper discharge valve 200T and fixed to the upper end plate 160T with the upper rivet 202T. The upper discharge valve retainer 201T limits the degree of the elastic deformation of the upper discharge valve 200T to limit the degree of opening of the upper discharge hole 190T that the upper discharge valve 200T opens and closes.

The upper end plate 160T is further formed with a plurality of bolt holes and a plurality of refrigerant passage holes. The bolt holes of the upper end plate 160T are arranged at substantially regular intervals on a circle with the rotational center line O as the center. The bolt holes of the upper end plate 160T are formed so as to communicate with the respective bolt holes 211-1 to 211-5 of the upper cylinder 121T when the compression part 12 is assembled (refer to FIG. 3). The through bolts 174 and 175 (refer to FIG. 2) are each inserted into the bolt holes of the upper end plate 160T.

The refrigerant passage holes of the upper end plate 160T are formed so as to communicate with the respective refrigerant passage holes 212-1 to 212-2 of the upper cylinder 121T (refer to FIG. 3). The refrigerant passage holes of the upper end plate 160T form part of the refrigerant passage 136 (refer to FIG. 1). The refrigerant passage holes of the upper end plate 160T are further formed such that at least part thereof is arranged so as to overlap with the upper discharge chamber recess 163T to communicate with the internal space of the upper discharge chamber recess 163T.

As illustrated in FIG. 2, the upper end plate cover 170T is fixed to the upper end plate 160T such that the upper end plate cover 170T is in intimate contact with the back of the face of the upper end plate 160T facing the upper cylinder 121T. The upper end plate cover 170T is formed with a dome-shaped swelling part 181. An upper end plate cover chamber 180T (refer to FIG. 1) is formed between the upper end plate 160T and the upper end plate cover 170T. The upper end plate cover 170T is formed with the swelling part 181, whereby the upper end plate cover chamber 180T is formed by the internal space of the swelling part 181, the internal space of the upper discharge chamber recess 163T, and the internal space of the upper discharge valve housing recess 164T. Consequently, the upper discharge hole 190T passes through the upper end plate 160T, thereby causing the upper compression chamber 133T of the upper cylinder 121T to communicate with the upper end plate cover chamber 180T.

As illustrated in FIG. 1, the refrigerant passage 136 causes the lower end plate cover chamber 180S and the upper end plate cover chamber 180T to communicate with each other.

The following describes the flow of the refrigerant by the rotation of the rotary shaft 15. The upper piston 125T is fit over the upper eccentric part 152T of the rotary shaft 15 and thereby revolves along the upper cylinder inner wall 123T within the upper cylinder chamber 130T when the rotary shaft 15 rotates. In the upper cylinder chamber 130T, the upper piston 125T revolves, whereby the volume of the upper suction chamber 131T increases, whereas the volume of the upper compression chamber 133T decreases. The upper suction chamber 131T, owing to its volume increase, sucks the refrigerant from the accumulator 25 via the accumulator upper curved pipe 31T, the upper suction pipe 105, and the upper suction hole 135T. The upper compression chamber 133T, owing to its volume decrease, compresses the refrigerant.

When the pressure of the refrigerant within the upper compression chamber 133T becomes higher than a certain pressure, the upper discharge valve 200T becomes elastically deformed to open the upper discharge hole 190T. When the upper discharge hole 190T is opened, the refrigerant within the upper compression chamber 133T is discharged from the upper compression chamber 133T to the upper end plate cover chamber 180T.

The lower piston 125S is fit over the lower eccentric part 152S of the rotary shaft 15 and thereby revolves along the lower cylinder inner wall 123S within the lower cylinder chamber 130S when the rotary shaft 15 rotates. In the lower cylinder chamber 130S, the lower piston 125S revolves, whereby the volume of the lower suction chamber 131S increases, whereas the volume of the lower compression chamber 133S decreases. The lower suction chamber 131S, owing to its volume increase, sucks the refrigerant from the accumulator 25 via the accumulator lower curved pipe 31S, the lower suction pipe 104, and the lower suction hole 135S. The lower compression chamber 133S, owing to its volume decrease, compresses the refrigerant.

When the pressure of the refrigerant within the lower compression chamber 133S becomes higher than a certain pressure, the lower discharge valve 200S becomes elastically deformed to open the lower discharge hole 190S.

When the lower discharge hole 190S is opened, the refrigerant within the lower compression chamber 133S is discharged from the lower compression chamber 133S to the lower end plate cover chamber 180S.

The refrigerant discharged to the lower end plate cover chamber 180S is discharged to the upper end plate cover chamber 180T via a plurality of refrigerant passages 136. The refrigerant discharged into the upper end plate cover chamber 180T is discharged into the compressor casing 10 via the upper end plate cover discharge hole 172T (refer to FIG. 1). The refrigerant discharged into the compressor casing 10 is guided to above the motor 11 within the compressor casing 10 through the gap 115, gaps of the coils, and the notch on the outer circumferential face of the stator 111 and is discharged to the outside of the compressor casing 10 via the discharge pipe 107.

The injection passage 140*a*, to which the liquid refrigerant is supplied from the injection pipe 142, supplies the liquid refrigerant to the injection hole 140*b*. The temperature of the liquid refrigerant supplied to the injection hole 140*b* is higher than the temperature of the refrigerant discharged from the accumulator 25 and is lower than the temperature of the refrigerant compressed by the upper compression chamber 133T and the lower compression chamber 133S. The upper piston 125T revolves, whereby the upper piston 125T opens the upper injection port 145 at a certain timing, and the injection hole 140*b* is connected to the upper compression chamber 133T at the certain timing. The injection hole 140*b* is connected to the upper compression chamber 133T at the certain timing, whereby the upper injection port 145 injects the liquid refrigerant into the upper compression chamber 133T at the certain timing. The lower piston 125S revolves, whereby the lower piston 125S opens the lower injection port 146 at the certain timing, and the injection hole 140*b* is connected to the upper compression chamber 133T at the certain timing. The injection hole 140*b* is connected to the upper compression chamber 133T at the certain timing, whereby the lower injection port 146 injects the liquid refrigerant into the lower compression chamber 133S at the certain timing.

The injection hole 140*b* is arranged such that the central angle θ is 40° or less and is thereby arranged near the upper vane groove 128T and the lower vane groove 128S (the upper vane 127T and the lower vane 127S). The injection hole 140*b* is arranged near the upper vane 127T and the lower vane 127S, whereby the rotary compressor 1 can mix the liquid refrigerant into the refrigerant in the latter stage of a period during which the refrigerant is compressed. The rotary compressor 1 mixes the refrigerant with the liquid refrigerant in the latter stage of the period during which the refrigerant is compressed and can thereby appropriately reduce the temperature of the refrigerant. The rotary compressor 1 reduces the temperature of the refrigerant and can thereby reduce heat loss caused by an increase in the temperature of the refrigerant when the refrigerant is compressed and increase the compression efficiency of the refrigerant. In other words, the injection hole 140*b* is arranged at a position reducing the heat loss and increasing the compression efficiency of the refrigerant; the position is a position such that the central angle θ is 40° or less.

The refrigerant passage holes 215-1 to 215-2 are formed on the outer circumferential side of the injection hole 140*b*, whereby the rotary compressor 1 can shorten the distance between the lower discharge hole 190S and the refrigerant passage holes 217-1 to 217-2. The distance between the lower discharge hole 190S and the refrigerant passage holes 217-1 to 217-2 is short, whereby the rotary compressor 1 can make the volume of the lower discharge chamber recess 163S smaller and make the volume of the lower end plate cover chamber 180S smaller. The upper end plate cover chamber 180T and the lower end plate cover chamber 180S communicate with each other via the refrigerant passage 136, whereby the rotary compressor 1 may cause the refrigerant to flow back from the upper end plate cover chamber 180T to the lower end plate cover chamber 180S via the refrigerant passage 136 to reduce the compression efficiency of the refrigerant. The rotary compressor 1 makes the volume of the lower end plate cover chamber 180S smaller and can thereby reduce the flow amount flowing back from the upper end plate cover chamber 180T into the lower end plate cover chamber 180S via the refrigerant passage 136 and prevent the reduction in the compression efficiency.

[Rotary Compressor of Comparative Example]

Figure 6:
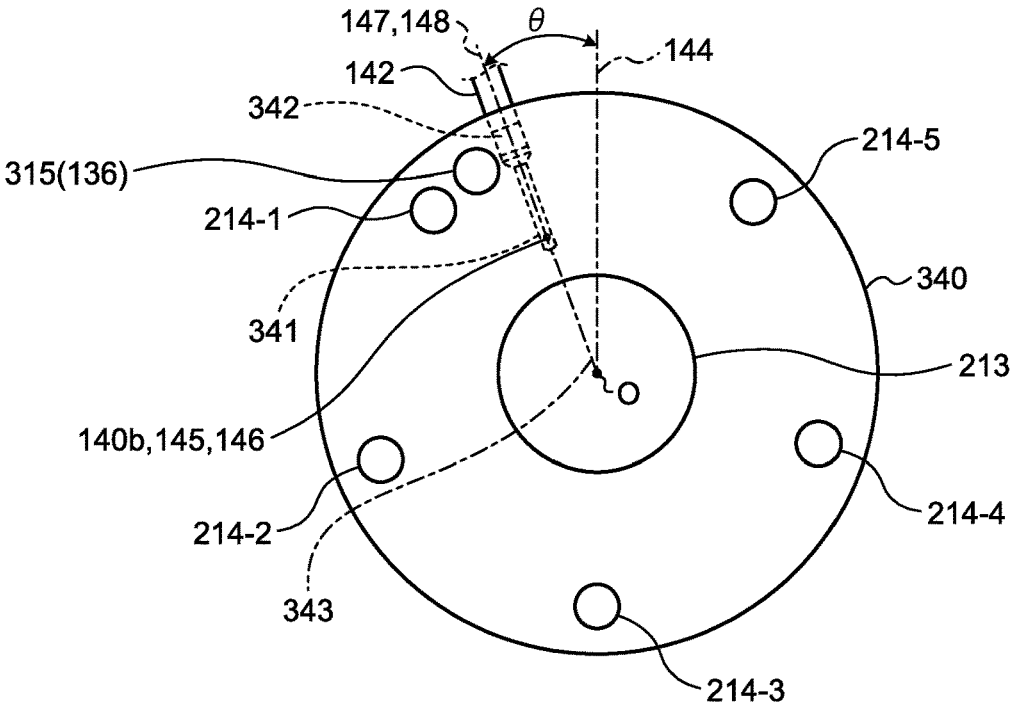
FIG. 6 is a bottom view of an intermediate partition plate of a rotary compressor of Comparative Example.

As illustrated in FIG. 6, in a rotary compressor of Comparative Example, the intermediate partition plate 140 of the rotary compressor 1 of the first embodiment is replaced with another intermediate partition plate 340. FIG. 6 is a bottom view of the intermediate partition plate 340 of the rotary compressor of Comparative Example. The intermediate partition plate 340 is formed with the rotary shaft insertion hole 213, a plurality of bolt holes 214-1 to 214-5, and the injection hole 140*b* like the intermediate partition plate 140. The intermediate partition plate 340 is further formed with an injection passage 341, an injection pipe fitting part 342, and a refrigerant passage hole 315. The injection passage 341 is formed linearly along a straight line 343. The straight line 343 is orthogonal to the rotational center line O and, that is, crosses the rotary shaft insertion hole 213 and crosses the rotary shaft 15. The injection passage 341 crosses the injection hole 140*b* to communicate with the injection hole 140*b*. The injection passage 341 is a blind hole; one end thereof is arranged on the outer circumference of the intermediate partition plate 340, whereas the other end thereof is arranged within the intermediate partition plate 340 to be blocked. The injection pipe fitting part 342 is formed at the end of the injection passage 341 connected to the outside of the intermediate partition plate 340. The injection pipe fitting part 342 is formed to have an inner diameter larger than the inner diameter of the injection passage 341.

The straight line 343 crosses the rotary shaft 15, whereby the injection passage 341 is arranged on the outer circumferential side of the injection hole 140*b* arranged on the perpendicular line 147 or the perpendicular line 148. The injection passage 341 is arranged on the outer circumferential side of the injection hole 140*b*, whereby the intermediate partition plate 340 is limited in an area in which the refrigerant passage hole 315 is formed. The refrigerant passage hole 315 is limited in an area in which it is arranged, whereby only one may be able to be formed, or its diameter may be required to be reduced. In the compression part 12 of the rotary compressor of Comparative Example, only one refrigerant passage hole 315 is formed, or the diameter of the refrigerant passage hole 315 is reduced, thereby making it harder for the refrigerant to pass through the refrigerant passage 136. The rotary compressor of Comparative Example makes it harder for the refrigerant to pass through the refrigerant passage 136, whereby noise in the 630 Hz band may increase, or calorie performance may worsen.

The rotary compressor 1 of the first embodiment can appropriately ensure an area in which through holes are formed on the outer circumference side of the injection hole 140*b* of the intermediate partition plate 140 compared with the rotary compressor of Comparative Example. The rotary compressor 1 can form the refrigerant passage holes 215-1 to 215-2 on the outer circumferential side of the injection hole 140*b* or form the diameter of the second refrigerant passage hole 215-2 to be larger than the diameter of the refrigerant passage hole 315, for example. The rotary compressor 1 forms the refrigerant passage holes 215-1 to 215-2 or forms the diameter of the second refrigerant passage hole 215-2 to be larger and can thereby make it easier for the refrigerant to pass through the refrigerant passage 136 than the rotary compressor of Comparative Example. The rotary compressor 1 makes it easy for the refrigerant to pass through the refrigerant passage 136 and can thereby reduce the noise in the 630 Hz band and improve calorie performance compared with the rotary compressor of Comparative Example. In addition, the rotary compressor 1 can form the first bolt hole 214-1 on the outer circumferential side of the injection hole 140*b*. The rotary compressor 1 forms the first bolt hole 214-1 together with the refrigerant passage holes 215-1 to 215-2 on the outer circumferential side of the injection hole 140*b* and can thereby appropriately fix the intermediate partition plate 140 while making the cross section of the refrigerant passage 136 larger.

The injection passage 140*a* is arranged between the first bolt hole 214-1 and the second bolt hole 214-2 different from the first bolt hole 214-1 among the bolt holes 214-1 to 214-5. When the injection passage 140*a* is arranged between the first bolt hole 214-1 and the fifth bolt hole 214-5, the liquid refrigerant passing through the injection passage 140*a* may be heated by the refrigerant sucked into the upper suction chamber 131T or the lower suction chamber 131S. The injection passage 140*a* is arranged between the first bolt hole 214-1 and the second bolt hole 214-2, whereby the rotary compressor 1 can make the injection passage 140*a* distant from the upper suction chamber 131T and the lower suction chamber 131S. The rotary compressor 1 makes the injection passage 140*a* distant from the upper suction chamber 131T and the lower suction chamber 131S and thereby makes it harder for the refrigerant within the upper suction chamber 131T and the refrigerant within the lower suction chamber 131S to be heated by the liquid refrigerant passing through the injection passage 140*a*. The rotary compressor 1 makes it harder for the refrigerant within the upper suction chamber 131T and the refrigerant within the lower suction chamber 131S to be heated by the liquid refrigerant and can thereby appropriately compress the refrigerant.

Effects of Rotary Compressor of the First Embodiment

As described above, the rotary compressor 1 of the first embodiment has the vertically installed cylindrical compressor casing 10, the accumulator 25, the motor 11, and the compression part 12. The compressor casing 10 is provided with the discharge pipe 107 discharging the refrigerant at an upper part, is provided with the upper suction pipe 105 and the lower suction pipe 104 sucking the refrigerant at a lower part of a side face, and is hermetically sealed. The accumulator 25 is fixed to the side part of the compressor casing 10 and is connected to the upper suction pipe 105 and the lower suction pipe 104. The motor 11 is arranged within the compressor casing 10. The compression part 12 is arranged below the motor 11 within the compressor casing 10 and is driven by the motor 11 to suck the refrigerant from the accumulator 25 via the upper suction pipe 105 and the lower suction pipe 104, compress the refrigerant, and discharge the refrigerant from the discharge pipe 107.

The compression part 12 includes the upper cylinder 121T, the lower cylinder 121S, the upper end plate 160T, the lower end plate 160S, the intermediate partition plate 140, and the rotary shaft 15. The upper end plate 160T blocks the upper side of the upper cylinder 121T. The lower end plate 160S blocks the lower side of the lower cylinder 121S. The intermediate partition plate 140 is arranged between the upper cylinder 121T and the lower cylinder 121S to block the lower side of the upper cylinder 121T and the upper side of the lower cylinder 121S. The rotary shaft 15 is supported on the main shaft bearing 161T provided in the upper end plate 160T and the sub shaft bearing 161S provided in the lower end plate 160S and is rotated by the motor 11.

The compression part 12 further includes the upper eccentric part 152T, the lower eccentric part 152S, the upper piston 125T, the lower piston 125S, the upper vane 127T, and the lower vane 127S. The upper eccentric part 152T and the lower eccentric part 152S are provided on the rotary shaft 15 with a phase difference of 180° with each other. The upper piston 125T forms the upper cylinder chamber 130T within the upper cylinder 121T, is fit over the upper eccentric part 152T, and revolves along the inner circumferential face of the upper cylinder 121T. The lower piston 125S forms the lower cylinder chamber 130S within the lower cylinder 121S, is fit over the lower eccentric part 152S, and revolves along the inner circumferential face of the lower cylinder 121S. The upper vane 127T protrudes from the upper vane groove 128T provided in the upper cylinder 121T into the upper cylinder chamber 130T and is in contact with the upper piston 125T to section the upper cylinder chamber 130T into the upper suction chamber 131T and the upper compression chamber 133T. The lower vane 127S protrudes from the lower vane groove 128S provided in the lower cylinder 121S into the lower cylinder chamber 130S and is in contact with the lower piston 125S to section the lower cylinder chamber 130S into the lower suction chamber 131S and the lower compression chamber 133S.

The intermediate partition plate 140 is formed with the injection hole 140*b* injecting the liquid refrigerant into the upper compression chamber 133T and the lower compression chamber 133S and the injection passage 140*a* supplying the liquid refrigerant to the injection hole 140*b*. The injection passage 140*a* is formed along the straight line 141 that does not cross the rotary shaft insertion hole 213 into which the rotary shaft 15 is inserted of the intermediate partition plate 140.

In such a rotary compressor 1, the injection passage 140*a* is formed along the straight line 141 and can thereby communicate with the injection hole 140*b* without passing through the outside of the injection hole 140*b* of the intermediate partition plate 140. Consequently, in the rotary compressor 1, even when the first refrigerant passage hole 215-1 and the first bolt hole 214-1 are formed outside the upper discharge hole 190T and the lower discharge hole 190S, the injection hole 140*b* is arranged near the upper discharge hole 190T and the lower discharge hole 190S.

In other words, in the rotary compressor 1, the injection passage 140*a* is formed along the straight line 141, whereby the injection passage 140*a* is not formed in an area on the outer circumferential side of the injection hole 140*b* of the intermediate partition plate 140. The injection passage 140*a* is not formed in the area on the outer circumferential side of the injection hole 140*b* of the intermediate partition plate 140, whereby the rotary compressor 1 can appropriately ensure the area in which the through holes are formed in the area on the outer circumferential side of the injection hole 140*b*. The compressor 1 ensures the area in which the through holes are formed in the area on the outer circumferential side of the injection hole 140*b* and can thereby form the refrigerant passage 136 causing the lower end plate cover chamber 180S and the upper end plate cover chamber 180T to communicate with each other near the lower discharge hole 190S, for example. The rotary compressor 1 ensures the area in which the through holes are formed in the area on the outer circumferential side of the injection hole 140*b* and can thereby further form the first bolt hole 214-1 fixing the intermediate partition plate 140 near the lower discharge hole 190S.

The upper vane 127T and the lower vane 127S of the rotary compressor 1 of the first embodiment are arranged along the plane 144 overlapping with the rotational center line O about which the rotary shaft 15 rotates. The central angle θ formed by the perpendicular line 147 drawn from the upper injection port 145 of the injection hole 140*b* to the rotational center line O and the straight line perpendicular to the rotational center line O among the straight lines parallel to the plane 144 is 40° or less. The central angle θ formed by the perpendicular line 148 drawn from the lower injection port 146 to the rotational center line O and the straight line perpendicular to the rotational center line O among the straight lines parallel to the plane 144 is 40° or less.

The injection hole 140*b* is formed such that the central angle θ is 40° or less, whereby such a rotary compressor 1 injects the liquid refrigerant into the upper compression chamber 133T and the lower compression chamber 133S at the certain timing. The rotary compressor 1 injects the liquid refrigerant at the certain timing and can thereby further reduce the amount of the liquid refrigerant to be injected into the upper compression chamber 133T and the lower compression chamber 133S to an optimized amount. The rotary compressor 1 reduces the suction amount of the liquid refrigerant to be injected into the upper compression chamber 133T and the lower compression chamber 133S and can thereby efficiently perform the residual compression cycle following the injection of the liquid refrigerant and improve the compression efficiency of refrigerant.

In other words, even when the injection hole 140*b* is formed such that the central angle θ is 40° or less, the rotary compressor 1 can ensure the area in which the through holes are formed on the outer circumferential side of the injection hole 140*b*. The injection passage 140*a* is along the straight line 141, whereby the injection hole 140*b* can be formed such that the central angle θ is 40° or less even when the through holes are formed on the outer circumferential side of the injection hole 140*b*.

By the way, although the injection hole 140*b* is formed such that the central angle θ is 40° or less in the rotary compressor 1 of the first embodiment, the injection hole 140*b* may be formed such that the central angle θ is greater than 40°.

The compression part 12 of the rotary compressor 1 of the first embodiment further includes the upper end plate cover 170T and the lower end plate cover 170S. The upper end plate cover 170T covers the upper end plate 160T to form the upper end plate cover chamber 180T between the upper end plate cover 170T and the upper end plate 160T and is provided with the upper end plate cover discharge hole 172T causing the upper end plate cover chamber 180T and the inside of the compressor casing 10 to communicate with each other. The lower end plate cover 170S covers the lower end plate 160S to form the lower end plate cover chamber 180S between the lower end plate cover 170S and the lower end plate 160S. The upper end plate 160T is formed with the upper discharge hole 190T causing the upper compression chamber 133T and the upper end plate cover chamber 180T to communicate with each other. The lower end plate 160S is formed with the lower discharge hole 190S causing the lower compression chamber 133S and the lower end plate cover chamber 180S to communicate with each other. The compression part 12 is formed with the refrigerant passage 136 causing the lower end plate cover chamber 180S and the upper end plate cover chamber 180T to communicate with each other. The refrigerant passage 136 is formed of a plurality of refrigerant passage holes each passing through the lower end plate 160S, the lower cylinder 121S, the intermediate partition plate 140, the upper end plate 160T, and the upper cylinder 121T. The injection hole 140*b* is arranged between the rotary shaft insertion hole 213 and the refrigerant passage holes 215-1 to 215-2 passing through the intermediate partition plate 140.

Such a rotary compressor 1 ensures the area in which the through holes are formed on the outer circumferential side of the injection hole 140*b* and can thereby form a plurality of refrigerant passage holes 215-1 to 215-2 or make the diameter of the refrigerant passage holes 215-1 to 215-2 larger. The rotary compressor 1 forms the refrigerant passage holes 215-1 to 215-2 or makes the diameter of the refrigerant passage holes 215-1 to 215-2 larger and can thereby make the cross section of the refrigerant passage 136 larger. The rotary compressor 1 makes the cross section of the refrigerant passage 136 larger and can thereby reduce noise occurring by the passage of the refrigerant through the refrigerant passage 136 and reduce the worsening of calorie performance.

Furthermore, the injection hole 140*b* is arranged between the refrigerant passage holes 215-1 to 215-2 and the rotary shaft insertion hole 213, whereby the rotary compressor 1 can arrange the refrigerant passage 136 near the lower discharge hole 190S. The distance between the lower discharge hole 190S and the entrance of the refrigerant passage 136 is short, whereby the rotary compressor 1 can make the lower end plate cover chamber 180S smaller and reduce the volume of the lower end plate cover chamber 180S. The rotary compressor 1 reduces the volume of the lower end plate cover chamber 180S and can thereby reduce resonance caused by the flowing of the refrigerant through the refrigerant passage 136 and reduce noise in the 800 Hz to 1.25 kHz band. The rotary compressor 1 reduces the noise and, even when the flow amount of the refrigerant flowing through the refrigerant passage 136 increases, can thereby reduce an increase in the noise caused by the increase in the flow amount of the refrigerant. The rotary compressor 1 reduces the volume of the lower end plate cover chamber 180S and can thereby further reduce the amount of the refrigerant flowing from the upper end plate cover chamber 180T into the lower end plate cover chamber 180S via the refrigerant passage 136. The rotary compressor 1 reduces the amount of the refrigerant flowing from the upper end plate cover chamber 180T into the lower end plate cover chamber 180S and can thereby supply the refrigerant from the lower end plate cover chamber 180S to the upper end plate cover chamber 180T with high efficiency and reduce an efficiency reduction.

The intermediate partition plate 140 of the rotary compressor 1 of the first embodiment is formed with a plurality of bolt holes 214-1 to 214-5. The compression part 12 further includes a plurality of through bolts 174 and 175. The through bolts 174 and 175 are each inserted into the bolt holes 214-1 to 214-5 to fix the lower end plate 160S, the lower cylinder 121S, the intermediate partition plate 140, the upper end plate 160T, and the upper cylinder 121T together. The injection hole 140*b* is arranged between the rotary shaft insertion hole 213 and the first bolt hole 214-1 among the bolt holes 214-1 to 214-5.

The rotary compressor 1 ensures the area in which the through holes are formed on the outer circumferential side of the injection hole 140*b* and can thereby form the first bolt hole 214-1 together with the refrigerant passage holes 215-1 to 215-2 on the outer circumferential side of the injection hole 140*b*. The rotary compressor 1 forms the first bolt hole 214-1 together with the refrigerant passage holes 215-1 to 215-2 on the outer circumferential side of the injection hole 140*b* and can thereby appropriately fix the intermediate partition plate 140 while making the cross section of the refrigerant passage 136 larger.

The injection passage 140*a* of the rotary compressor 1 of the first embodiment is arranged between the first bolt hole 214-1 and the second bolt hole 214-2 different from the first bolt hole 214-1 among the bolt holes 214-1 to 214-5. The second bolt hole 214-2 is arranged near the upper compression chamber 133T and the lower compression chamber 133S in comparison with the upper vane 127T and the lower vane 127S. The injection passage 140*a* is arranged between the first bolt hole 214-1 and the second bolt hole 214-2 among the bolt holes 214-1 to 214-5.

The injection passage 140*a* is arranged between the first bolt hole 214-1 and the second bolt hole 214-2, whereby such a rotary compressor 1 can make the injection passage 140*a* distant from the upper suction chamber 131T and the lower suction chamber 131S. The rotary compressor 1 makes the injection passage 140*a* distant from the upper suction chamber 131T and the lower suction chamber 131S and thereby makes it harder for the refrigerant within the upper suction chamber 131T and the refrigerant within the lower suction chamber 131S to be heated by the liquid refrigerant passing through the injection passage 140*a*. The rotary compressor 1 makes it harder for the refrigerant within the upper suction chamber 131T and the refrigerant within the lower suction chamber 131S to be heated by the liquid refrigerant and can thereby appropriately compress the refrigerant.

Although the injection hole 140*b* is arranged in the area between the first bolt hole 214-1 and the rotary shaft insertion hole 213 in the rotary compressor 1 of the first embodiment, the injection hole 140*b* may be formed in another area different from that area.

Second Embodiment

Figure 7:
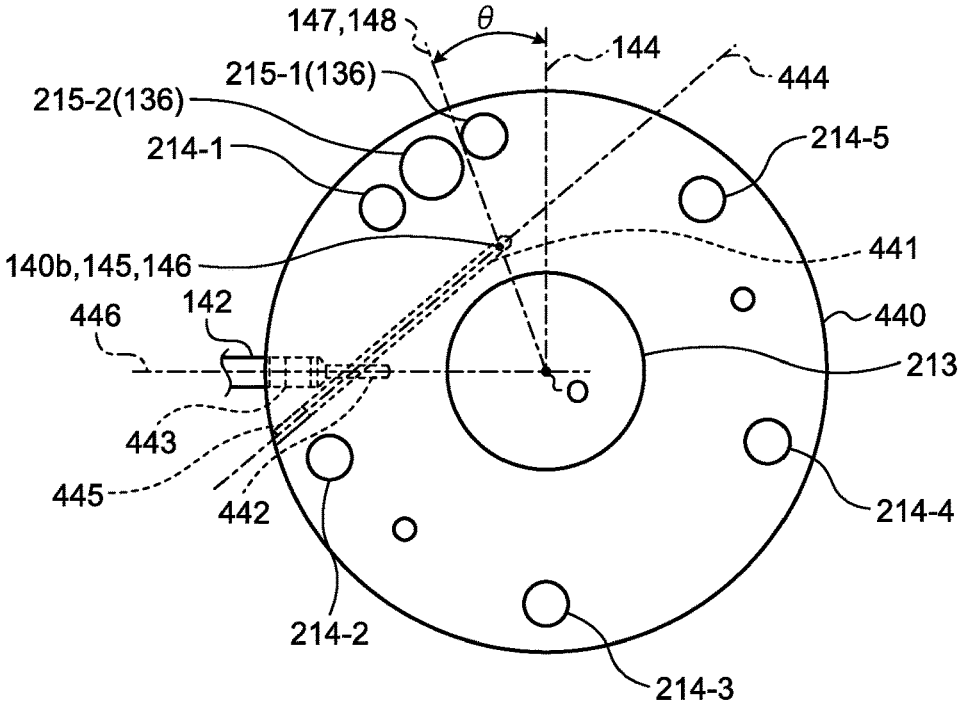
FIG. 7 is a bottom view of an intermediate partition plate of a rotary compressor of a second embodiment.

In a rotary compressor of a second embodiment, the intermediate partition plate 140 of the rotary compressor 1 of the first embodiment is replaced with another intermediate partition plate 440. FIG. 7 is a bottom view of the intermediate partition plate 440 of the rotary compressor of the second embodiment. As illustrated in FIG. 7, the intermediate partition plate 440 is formed in a disc shape and is formed with the rotary shaft insertion hole 213 and the injection hole 140*b* like the intermediate partition plate 140 of the rotary compressor 1 of the first embodiment. The intermediate partition plate 440 is further formed with a first injection passage 441, a second injection passage 442, and an injection pipe fitting part 443. The first injection passage 441 is formed along a straight line 444. The straight line 444 is perpendicular to the rotational center line O and does not cross the rotary shaft insertion hole 213. The first injection passage 441 crosses the injection hole 140*b* to communicate with the injection hole 140*b*. Furthermore, one end of the first injection passage 441 is arranged on the outer circumference of the intermediate partition plate 440, whereas the other end thereof is arranged within the intermediate partition plate 440 to be blocked.

The rotary compressor of the second embodiment further includes a seal member 445. The seal member 445 is formed of metal or resin and is stuffed into the end of the first injection passage 441 arranged on the outer circumference of the intermediate partition plate 440 to block the end.

The second injection passage 442 is a blind hole; one end thereof is arranged on the outer circumference of the intermediate partition plate 440, whereas the other end thereof is arranged within the intermediate partition plate 440 to be blocked. The second injection passage 442 is further formed along a straight line 446. The straight line 446 is perpendicular to the rotational center line O and crosses the rotational center line O and, that is, crosses the rotary shaft 15 and crosses the rotary shaft insertion hole 213. The injection pipe fitting part 443 is formed at the end of the second injection passage 442 connected to the outside of the intermediate partition plate 440. The injection pipe fitting part 443 is formed to have an inner diameter larger than the inner diameter of the second injection passage 442. One end of the injection pipe 142 arranged within the compressor casing 10 is fit into the injection pipe fitting part 443.

The second injection passage 442 is formed along the straight line 446, whereby the injection pipe 142 is arranged along the straight line 446. In the compressor casing 10 of the rotary compressor of the second embodiment, the injection pipe 142 is arranged along the straight line 446, whereby the injection port through which the injection pipe 142 passes can be formed substantially perpendicular to the outer circumferential face of the compressor casing 10. The injection port is formed substantially perpendicular to the outer circumferential face of the compressor casing 10, whereby the compressor casing 10 can easily be processed.

The rotary compressor of the second embodiment compresses a refrigerant by the rotation of the rotary shaft 15 like the rotary compressor 1 of the first embodiment. The following describes the flow of a liquid refrigerant. The injection pipe 142, to which the liquid refrigerant is supplied, supplies the liquid refrigerant to the second injection passage 442. The second injection passage 442, to which the liquid refrigerant is supplied from the injection pipe 142, supplies the liquid refrigerant to the first injection passage 441. The first injection passage 441, to which the liquid refrigerant is supplied from the second injection passage 442, supplies the liquid refrigerant to the injection hole 140*b*. The injection hole 140*b*, to which the liquid refrigerant has been supplied from the first injection passage 441, injects the liquid refrigerant into the upper compression chamber 133T via the upper injection port 145 when the upper piston 125T opens the upper injection port 145. The injection hole 140*b*, to which the liquid refrigerant has been supplied from the first injection passage 441, further injects the liquid refrigerant into the lower compression chamber 133S via the lower injection port 146 when the lower piston 125S opens the lower injection port 146. The rotary compressor of the second embodiment injects the liquid refrigerant into the upper compression chamber 133T and the lower compression chamber 133S and can thereby appropriately decrease the temperature of the refrigerant to be compressed and increase the compression efficiency of the refrigerant like the rotary compressor 1 of the first embodiment.

Effects of Rotary Compressor of the Second Embodiment

The intermediate partition plate 440 of the rotary compressor of the second embodiment is formed with the second injection passage 442 connected to the first injection passage 441. The compression part 12 further includes the injection pipe 142. The injection pipe 142 is inserted into the injection pipe fitting part 443 of the second injection passage 442 to supply the liquid refrigerant to the second injection passage 442 from outside the compressor casing 10. The second injection passage 442 is formed along the straight line 446 crossing the rotary shaft 15.

In such a rotary compressor, the second injection passage 442 is formed along the straight line 446, whereby the injection pipe 142 inserted into the second injection passage 442 can be inserted into the compressor casing 10 substantially perpendicularly. In the rotary compressor, the injection pipe 142 is inserted into the compressor casing 10 substantially perpendicularly, whereby the injection port through which the injection pipe 142 passes can easily be formed in the compressor casing 10, and the compressor casing 10 can easily be produced.

The compression part 12 of the rotary compressor of the second embodiment further includes the seal member 445. The seal member 445 seals an open end of the first injection passage 441 connected to the outer circumferential face of the intermediate partition plate 440.

The open end of the first injection passage 441 is sealed, whereby such a rotary compressor can appropriately supply the liquid refrigerant from the first injection passage 441 to the injection hole 140*b* without a leakage of the liquid refrigerant from the open end. The liquid refrigerant is appropriately supplied to the injection hole 140*b*, whereby the rotary compressor can appropriately inject the liquid refrigerant into the upper compression chamber 133T and the lower compression chamber 133S.

Although the seal member 445 seals the open end of the first injection passage 441 in the rotary compressor of the second embodiment, the seal member 445 may be omitted when the liquid refrigerant does not leak from the open end of the first injection passage 441. A part at which the open end of the first injection passage 441 is formed of the outer circumferential face of the intermediate partition plate 440 is formed being in intimate contact with the inner circumferential face of the compressor casing 10, whereby the rotary compressor can prevent the liquid refrigerant from leaking from the open end, for example. Even when the seal member 445 is omitted, the first injection passage 441 is formed along the straight line 444, whereby the rotary compressor can arrange the injection hole 140*b* near the upper discharge hole 190T and the lower discharge hole 190S.

Although the injection passage 140*a* and the second injection passage 442 are formed to be blind holes in the examples, they are formed along the straight lines 141 and 444 that do not cross the rotary shaft insertion hole 213 and can thereby also be formed to be through holes. When they are formed to be through holes, the ends of the injection passage 140*a* and the second injection passage 442 in the liquid refrigerant flowing direction are blocked. The injection passage 140*a* and the second injection passage 442 are formed along the straight lines 141 and 444, whereby even when they are formed to be through holes, the liquid refrigerant can appropriately be supplied to the injection hole 140*b* without communicating with the rotary shaft insertion hole 213. Although the injection hole 140*b* is provided in the thickness direction of the intermediate partition plates 140 and 440 (a direction parallel to the rotational center line O) to pass therethrough, the axial direction of the center of the injection hole 140*b* is not limited to the direction of the rotational center line O. The central axis of the injection hole 140*b* may be inclined relative to the thickness direction of the intermediate partition plates 140 and 440 so as to inject the liquid refrigerant in a direction departing from the upper discharge hole 190T and the lower discharge hole 190S, for example.

The examples have been described, in which the examples are not limited to the details described above. The components described above include ones that those skilled in the art can easily think of, substantially the same ones, and ones within what is called equivalents. Furthermore, the components described above can be combined as appropriate. Furthermore, at least one of various omissions, replacements, and modifications of the components can be made without departing from the gist of the examples.

REFERENCE SIGNS LIST

1 Rotary compressor
10 Compressor casing
12 Compression part
15 Rotary shaft
121S Lower cylinder
121T Upper cylinder
125S Lower piston
125T Upper piston
127S Lower vane
127T Upper vane
130S Lower cylinder chamber
130T Upper cylinder chamber
131S Lower suction chamber
131T Upper suction chamber
133S Lower compression chamber
133T Upper compression chamber
136 Refrigerant passage
140 Intermediate partition plate
140*a* Injection passage
140*b* Injection hole
141 Straight line
142 Injection pipe
144 Plane
145 Upper injection port
146 Lower injection port
147 Perpendicular line
148 Perpendicular line
160S Lower end plate
160T Upper end plate
213 Rotary shaft insertion hole
214-1 to 214-5 Plurality of bolt holes
215-1 to 215-2 Plurality of refrigerant passage holes
440 Intermediate partition plate
441 First injection passage
442 Second injection passage
444 Straight line
445 Seal member
446 Straight line

The invention claimed is:

1. A rotary compressor comprising:

a compressor casing that is formed in a substantially cylindrical shape, is vertically installed, is provided with a discharge pipe discharging a refrigerant at an upper part, is provided with an upper suction pipe and a lower suction pipe sucking the refrigerant at a lower part of a side face, and is hermetically sealed;

an accumulator that is fixed to a side part of the compressor casing and connected to the upper suction pipe and the lower suction pipe;

a motor that is arranged within the compressor casing; and a compression part that is arranged below the motor within the compressor casing and driven by the motor to suck the refrigerant from the accumulator via the upper suction pipe and the lower suction pipe, compress the refrigerant, and discharge the refrigerant from the discharge pipe, wherein the compression part includes:

an upper cylinder that is formed in an annular shape;

a lower cylinder that is formed in an annular shape;

an upper end plate that blocks an upper side of the upper cylinder;

a lower end plate that blocks a lower side of the lower cylinder;

an intermediate partition plate that is arranged between the upper cylinder and the lower cylinder to block a lower side of the upper cylinder and an upper side of the lower cylinder;

a rotary shaft that is supported on a main shaft bearing provided in the upper end plate and a sub shaft bearing provided in the lower end plate and rotated by the motor;

an upper eccentric part and a lower eccentric part that are provided on the rotary shaft with a phase difference of 180° with each other;

an upper piston that is fitted over the upper eccentric part to form an upper cylinder chamber within the upper cylinder and is revolving along an inner circumferential face of the upper cylinder;

a lower piston that is fitted over the lower eccentric part to form a lower cylinder chamber within the lower cylinder and is revolving along an inner circumferential face of the lower cylinder;

an upper vane that protrudes from an upper vane groove formed in the upper cylinder into the upper cylinder chamber and is in contact with the upper piston to section the upper cylinder chamber into an upper suction chamber and an upper compression chamber; and a lower vane that protrudes from a lower vane groove formed in the lower cylinder into the lower cylinder chamber and is in contact with the lower piston to section the lower cylinder chamber into a lower suction chamber and a lower compression chamber, the intermediate partition plate being formed with:

an injection hole that injects a liquid refrigerant into the upper compression chamber and the lower compression chamber;

an injection passage that supplies the liquid refrigerant to the injection hole; and an other injection passage connected to the injection passage, the injection passage is formed along a straight line that does not cross a rotary shaft insertion hole into which the rotary shaft is inserted of the intermediate partition plate, the other injection passage is formed along another straight line crossing the rotary shaft insertion hole, and the compression part further includes an injection pipe that is inserted into the other injection passage to supply the liquid refrigerant from outside of the compressor casing to the other injection passage, and a seal member that is stuffed into an open end of the injection passage arranged on an outer circumferential face of the intermediate partition plate to block the open end.

2. A rotary compressor comprising:

a compressor casing that is formed in a substantially cylindrical shape, is vertically installed, is provided with a discharge pipe discharging a refrigerant at an upper part, is provided with an upper suction pipe and a lower suction pipe sucking the refrigerant at a lower part of a side face, and is hermetically sealed;

an accumulator that is fixed to a side part of the compressor casing and connected to the upper suction pipe and the lower suction pipe;

a motor that is arranged within the compressor casing; and a compression part that is arranged below the motor within the compressor casing and driven by the motor to suck the refrigerant from the accumulator via the upper suction pipe and the lower suction pipe, compress the refrigerant, and discharge the refrigerant from the discharge pipe, wherein the compression part includes:

an upper cylinder that is formed in an annular shape;

a lower cylinder that is formed in an annular shape;

an upper end plate that blocks an upper side of the upper cylinder;

a lower end plate that blocks a lower side of the lower cylinder;

an intermediate partition plate that is arranged between the upper cylinder and the lower cylinder to block a lower side of the upper cylinder and an upper side of the lower cylinder;

a rotary shaft that is supported on a main shaft bearing provided in the upper end plate and a sub shaft bearing provided in the lower end plate and rotated by the motor;

an upper eccentric part and a lower eccentric part that are provided on the rotary shaft with a phase difference of 180° with each other;

an upper piston that is fitted over the upper eccentric part to form an upper cylinder chamber within the upper cylinder and is revolving along an inner circumferential face of the upper cylinder;

a lower piston that is fitted over the lower eccentric part to form a lower cylinder chamber within the lower cylinder and is revolving along an inner circumferential face of the lower cylinder;

an upper vane that protrudes from an upper vane groove formed in the upper cylinder into the upper cylinder chamber and is in contact with the upper piston to section the upper cylinder chamber into an upper suction chamber and an upper compression chamber; and a lower vane that protrudes from a lower vane groove formed in the lower cylinder into the lower cylinder chamber and is in contact with the lower piston to section the lower cylinder chamber into a lower suction chamber and a lower compression chamber, the intermediate partition plate being formed with:

an injection hole that injects a liquid refrigerant into the upper compression chamber and the lower compression chamber; and an injection passage that supplies the liquid refrigerant to the injection hole, the injection passage is formed along a straight line that does not cross a rotary shaft insertion hole into which the rotary shaft is inserted of the intermediate partition plate, and the compression part further includes:

an upper end plate cover that covers the upper end plate to form an upper end plate cover chamber between the upper end plate cover and the upper end plate and has an upper end plate cover discharge hole causing the upper end plate cover chamber and inside of the compressor casing to communicate with each other; and a lower end plate cover that covers the lower end plate to form a lower end plate cover chamber between the lower end plate cover and the lower end plate, the upper end plate is formed with an upper discharge hole causing the upper compression chamber and the upper end plate cover chamber to communicate with each other, the lower end plate is formed with a lower discharge hole causing the lower compression chamber and the lower end plate cover chamber to communicate with each other, the compression part is formed with a refrigerant passage formed of a plurality of refrigerant passage holes each passing through the lower end plate, the lower cylinder, the intermediate partition plate, the upper end plate, and the upper cylinder and causing the lower end plate cover chamber and the upper end plate cover chamber to communicate with each other, and the injection hole is arranged between the rotary shaft insertion hole and a refrigerant passage hole passing through the intermediate partition plate among the refrigerant passage holes.

3. The rotary compressor according to claim 2, wherein the upper vane and the lower vane are arranged along a plane overlapping with a rotational center line about which the rotary shaft rotates, and a central angle formed by a perpendicular line drawn from an injection port injecting the liquid refrigerant from the injection hole into the upper compression chamber and the lower compression chamber to the rotational center line and a straight line perpendicular to the rotational center line among straight lines parallel to the plane is 40° or less.

4. The rotary compressor according to claim 2, wherein the intermediate partition plate is formed with a plurality of bolt holes, the compression part further includes a plurality of bolts that is inserted into the bolt holes to fix the lower end plate, the lower cylinder, the intermediate partition plate, the upper end plate, and the upper cylinder together, and the injection hole is arranged between the rotary shaft insertion hole and one bolt hole among the bolt holes.

5. The rotary compressor according to claim 4, wherein the injection passage is arranged between the one bolt hole and an other bolt hole different from the one bolt hole among the bolt holes, and the other bolt hole is arranged near the upper compression chamber and the lower compression chamber in comparison with the upper vane and the lower vane.

6. The rotary compressor according to claim 2, wherein the intermediate partition plate is further formed with an other injection passage connected to the injection passage, the compression part further includes an injection pipe that is inserted into the other injection passage to supply the liquid refrigerant from outside of the compressor casing to the other injection passage, and the other injection passage is formed along another straight line crossing the rotary shaft insertion hole.

7. The rotary compressor according to claim 6, wherein the compression part further includes a seal member configured to be inserted into an open end connected to an outer circumferential face of the intermediate partition plate of the injection passage.

* * * * *